United States Patent [19]

Johnston

[11] Patent Number: 4,531,591

[45] Date of Patent: Jul. 30, 1985

[54] DRILLING HEAD METHOD AND APPARATUS

[75] Inventor: Vaughn R. Johnston, Washington, Pa.

[73] Assignee: Washington Rotating Control Heads, Washington, Pa.

[21] Appl. No.: 526,067

[22] Filed: Aug. 24, 1983

[51] Int. Cl.[3] ..... E21B 33/03

[52] U.S. Cl. ..... 175/57; 277/3; 277/31; 175/195; 166/84

[58] Field of Search ..... 175/57, 195, 209, 210, 175/214; 166/82, 84, 86; 277/3, 31

[56] References Cited

U.S. PATENT DOCUMENTS

| | | | |
|---|---|---|---|
| 2,170,916 | 8/1939 | Schweitzer et al. . | |
| 2,862,735 | 12/1958 | Knox . | |
| 3,029,083 | 4/1962 | Wilde . | |
| 3,128,614 | 4/1964 | Auer . | |
| 3,387,851 | 6/1968 | Cugini . | |
| 3,400,938 | 9/1968 | Williams . | |
| 3,503,617 | 3/1970 | Williams . | |
| 4,345,769 | 8/1982 | Johnston | 277/31 |
| 4,363,357 | 12/1982 | Hunter | 175/209 |
| 4,367,791 | 1/1983 | Bittle | 175/195 |
| 4,423,776 | 1/1984 | Wagoner et al. | 175/195 |

*Primary Examiner*—Stephen J. Novosad
*Assistant Examiner*—William P. Neuder
*Attorney, Agent, or Firm*—Carothers & Carothers

[57] ABSTRACT

A rotary drilling head wherein rotary friction between the rotary spindle assembly and the spindle housing is limited by improvements in bearing and seal lubrication and by seal structure such that the gripping action of a resiliently flexible packer on a drill string provides a rotary drive connection sufficient to impart rotation to the spindle assembly through rotation of the drill string.

17 Claims, 3 Drawing Figures

DRILLING HEAD METHOD AND APPARATUS

Drilling of oil and gas wells is accomplished by means of a drill bit attached to the forward end of a hollow string of drilling pipe. The drill string receives a rotary motion from power equipment such as a rotary table located on the surface which transmits this rotary motion to the circular drill string through a non-circular member attached to the top of the drill string and known as a drill kelly. The kelly receives its rotary motion from the power equipment through a non-circular bushing located in the drilling floor and through which the kelly slides. As drilling progresses, additional sections of drill pipe are added by the procedure of stopping the drilling, raising the kelly and the attached drilling string, uncoupling the kelly from the string, adding a new section of drilling pipe, and then recoupling the kelly.

Below the drilling floor and on the ground surface a variety of specialized equipment is usually attached to the top of the well casing where it emerges from the ground. Among these types of equipment is usually a component known as a drilling head which provides means for the sealing of the interior of the well casing from the surface to thereby permit the forced circulation of drilling fluid or gas during drilling operations. In the more commonly used forward circulation drilling operation, the drilling fluid or gas is pumped downwardly through the interior of the drill string, out the bottom thereof at the bottom of the well bore and upwardly through the annulus defined between the exterior of the drill string and the interior surface of the well casing. The fluid moving upwardly through the annulus entrains the cutting and debris at the bottom of the bore hole and carries it to the surface. In reverse circulation, the drilling fluid or gas is pumped down the annulus between the drill string and the well casing or well bore, through the drill bit and upward through the drill string.

In the prior art, drilling heads usually have included an outer stationary body or casing and a rotatable spindle carried therein. The rotatable spindle is matable in driving engagement with the kelly and rotates with the kelly during the rotary drilling operation. The kelly and drill string are slidable through the spindle and the kelly engages and rotates the spindle during the drilling operation. Sealing or packing means are provided in the drilling head between the spindle and the kelly or the sections of drill string, whichever is passing through the spindle. The packing, commonly referred to as a stripper packer, is customarily provided about the kelly and drill string and arranged between these conduits and the rotating spindle. Conventional packings are provided to confine the pressures in the well casing and to prevent the drilling fluid, whether liquid or gas, from escaping between the spindle and the slidable members of the drill string.

In order to maintain a seal around the drilling kelly and drill stem during drilling and particularly when the kelly and drill stem are being removed from the bore, numerous stripper packers have been developed to provide rotational and slidable sealing of the drill string within the drilling head. The rotation of the kelly and drill string, the frequent upward and downward movement of the kelly and drill stem during addition of drill stem sections, and the high pressures to which the drilling head is subjected, demand that the packing components in the drilling head be able to reliably withstand the harsh environment in continuous use without incurring excessive wear rates. As modern oil and gas wells go to increasingly greater depths, the need for sturdy and reliable drill heads increases. In addition, the increasing popularity of air drilling combined with the increasing depth of new wells demand more efficient means of sealing the drill string against release of internal drilling fluid pressure.

The prior art of drilling heads as characterized above for table drive drilling rigs has been comparable for so-called top-head drive drilling rigs wherein the rotary driving force is imparted to the drill string not through a rotary table in the drilling floor which rotatably engages a kelly bar, but rather through an elevated rotary drive which rotatably engages the upper most end of the drill string above the drilling floor. In such top-head drive rigs, a separate rotary drive connection such as a set of rotary drive lugs or a kelly bar has commonly been provided to impart rotation from the drill string to the drilling head spindle whereby spindle, packer and drill string rotate in unison during drilling. For example, such drive lugs have often been provided adjacent the top of the drilling head spindle for engagement with cooperating lugs which rotate with the drill string.

Various drilling heads have been provided in the prior art, the following U.S. Patents being exemplary: Nos. 4,345,769; 3,503,617; 3,400,938; 3,387,851; 3,128,614; 3,029,083; 2,862,735 and 2,170,916.

The present invention contemplates an improved drilling head specifically for use in top-head drilling rigs. The invention provides for improved lubrication of rotary bearings, improved sealing capability between relatively rotating parts, and an improved rotary drive connection between the drill string and the drilling head spindle assembly. Specifically, the rotary drive connection is provided by the sealing grip of the stripper packer about the drill string whereby no other rotary drive connection is required to provide rotational impetus to the drilling head spindle assembly. In order to accomplish this, it has been deemed highly desirable to provide low friction seals between the rotary spindle assembly and the stationary housing of the drilling head. A labyrinth groove sealing arrangement enhances the sealing capability between the relatively rotating components and permits the use of low friction seals as debris from the well bore is trapped by the labyrinth groove seal structure, and thus does not reach the low friction seals.

Lubrication means are also provided to enhance ease of rotation in that the rotary bearings of the spindle are continuously bathed in lubricant under pressure, rather than with a metered lubricant flow. A metered lubricant flow is provided from the pressurized lubricant volume adjacent the rotary bearings of the low friction rotary seals. Thus, the low friction seals are isolated from the pressure of lubricant on the rotary bearings. This allows use of low friction seals as higher lubricant pressure would require higher friction seals to contain the pressure.

Also provided by the present invention is an improved clamp ring and cooperating mating or junction portion of the upper and lower body portions of the drilling head wherein the mating portions of the drilling head are maintained in metal-to-metal contact without need of additional sealing members therebetween and the clamping provides for positive self-aligning and clamping of the upper and lower drilling head portions.

The clamp ring includes a releasable clamp securing assembly which is contained within the outer diameter of the clamp ring, whereby such outer diameter defines the maximum transverse dimension of the drilling head and no additional clearance is required to accommodate the clamp securing assembly.

Other objects and advantages appear in the following description and claims.

The accompanying drawings show, for the purpose of exemplification without limiting the invention or the claims thereto, certain practical embodiments illustrating the principles of this invention wherein:

Figure 1:
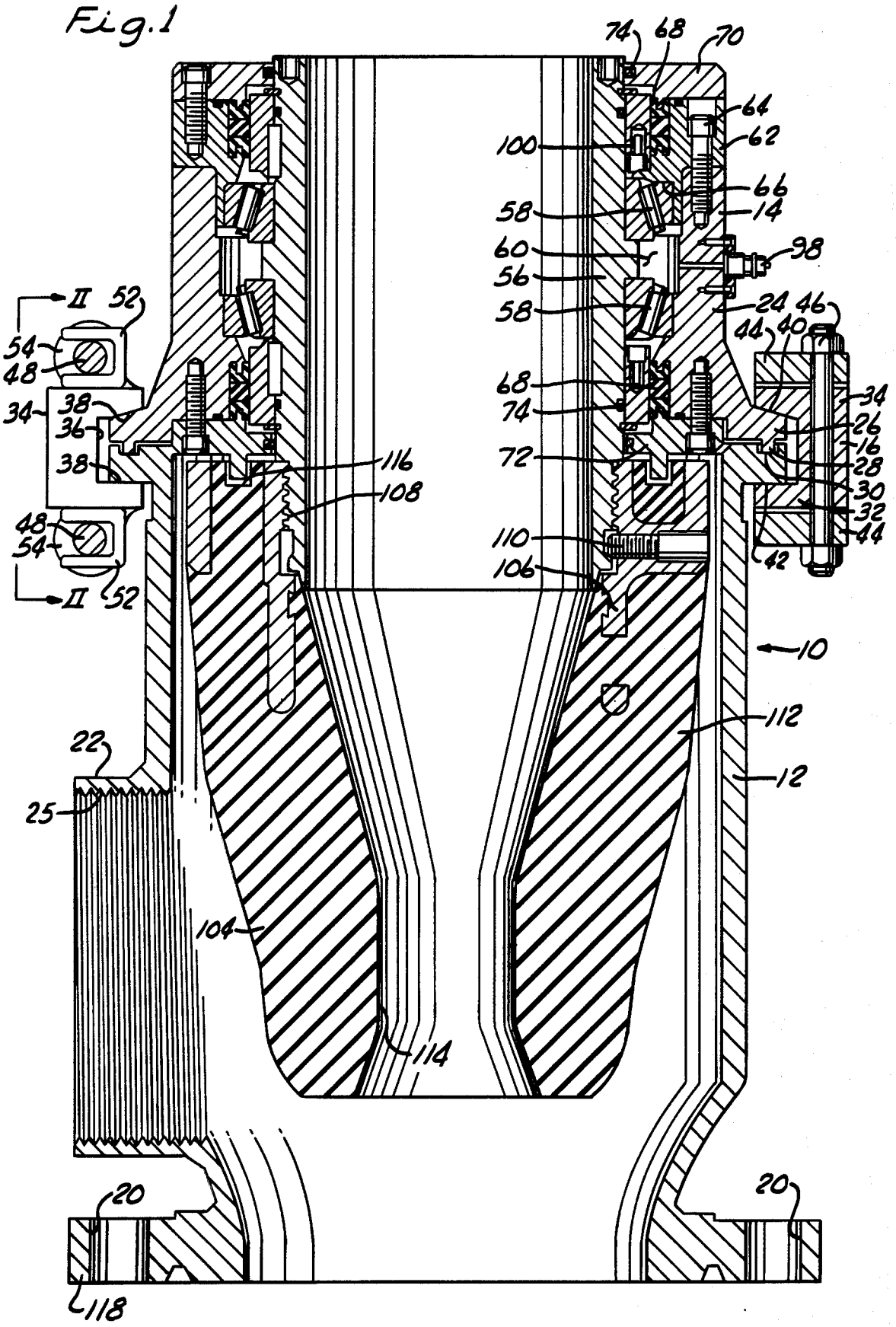
FIG. 1 is a sectional elevation of a drilling head according to one presently preferred embodiment of the present invention.

There is generally indicated at 10 in FIG. 1 a drilling head according to one presently preferred embodiment of the present invention, and including a generally elongated cylindrical body portion 12 which is secured coaxially subjacent a spindle assembly 14 by a clamp assembly 16.

Body portion 12 includes adjacent its lower end of annular flange 18 by which body 12 is secured to a mating flange on the upper end of a conventional well casing (not shown) as by suitable nut and bolt assemblies (not shown) passing through a plurality of axial bores 20 spaced circumferentially about flange 18. Drilling head 10 is thus maintained in coaxial alignment with the well casing. Body portion 12 further includes a radially-directed side connection 22 which may be provided with internal threads 25 for coupling with a suitable pipe or conduit to direct drilling fluid from the bore hole (for forward circulation) or to the bore hole (for reverse circulation) during drilling operations.

Spindle assembly 14 includes a generally cylindrical, stationary member 24 having a radially outwardly projecting annular flange 26 formed adjacent the lower end thereof and which includes a downwardly projecting annular ring portion 28 that is received into a mating annular groove 30 formed in a radially outwardly projecting flange 32 formed adjacent the upper end of body portion 12. The bottom of groove 30 and the outer surface of annular ring 28 are maintained in tight face sealing engagement by clamp assembly 16. Specifically, clamp assembly 16 includes a pair of generally semi-circular clamp ring sections 34 (FIGS. 1 and 2), each having a radially inwardly facing formed groove 36 with side walls 38 which diverge radially inwardly from one another. Cooperable outer surfaces 40 and 42 of flanges 26 and 32, respectively, diverge radially inwardly from one another in complementary fashion whereby the clamping ring sections 34 may be engaged upon flanges 26 and 32 and drawn up to tightly wedge flanges 26 and 32 together in self-aligning sealed and non-rotary relationship.

To facilitate ease of attachment and release of clamp assembly 16, the two semi-circular ring sections 34 are pivotally secured together end-to-end as by hinge plate elements 44 rigidly affixed adjacent an end of one of ring sections 34 and pivotally secured to an end of the other ring section 34, as by a nut and bolt assembly 46 which passes through aligned cooperating bores in hinge plates 44 and the end of the adjacent ring section 34 located between hinge plates 44. The ring elements 34 are pivotally secured together with groove 36 facing radially inward whereby the pivoted ring sections 34 may be spread or opened to receive the juxtaposed flanges 26 and 32 therein and may then be closed over flanges 26 and 32 to encompass and captively retain the flanges 26 and 32.

Figure 2:
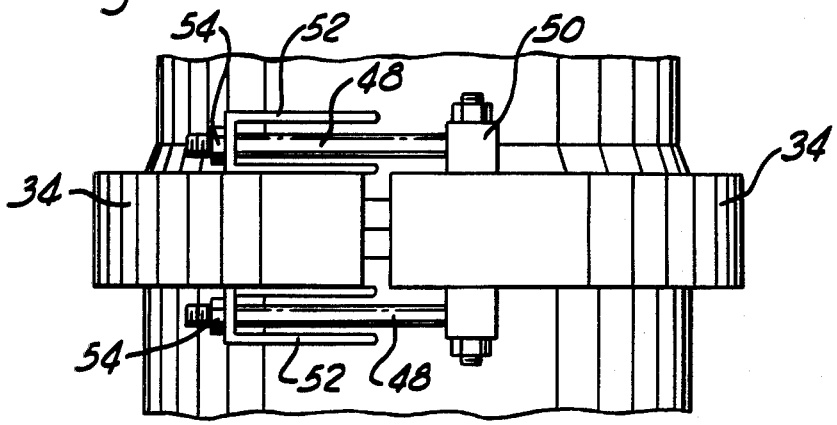
FIG. 2 is a fragmentary elevation taken on line II—II of FIG. 1.

To retain the clamp assembly 16 in tight wedging engagement with flanges 26 and 32, upper and lower clamp bolt assemblies 48 are pivotally secured adjacent upper and lower surfaces adjacent the free end of one ring section 34 as by a nut and bolt assembly 50 (FIG. 2). Bolts 48 are pivotable into engagement with elongated, radially outwardly opening channel members 52 which are affixed as by welding to the respective upper and lower surfaces adjacent the free end of the outer ring section 34. Suitable nut and washer means 54 are provided for threaded engagement upon the ends of respective bolts 48 whereby the nut and washer means may be drawn up tight against channel sections 52 to draw ring sections 34 into tightly clamped wedging engagement with flanges 26 and 32 to maintain spindle assembly 14 in sealed coaxial alignment with housing 12.

Spindle assembly 14 includes the cylindrical, stationary housing member 24 within which is coaxially, rotationally received a generally cylindrical spindle member 56. Rotary bearing assemblies 58 are provided within a suitably formed, generally annular space 60 defined radially intermediate spindle member 56 and spindle housing 24. To provide for convenient assembly of spindle member 56 and bearings 58 into housing 24, upper portion 62 of housing 24 is releasably secured as by threaded fasteners 64. Formed interior surface portions 66 of body portion 62 bear on support portions of the upper bearings assembly 58. The bearings 58 and the manner of retention thereof between relatively rotating parts, and in addition the resulting manner in which the relatively rotating components are retained with respect to one another are all well known in the art and further detailed description thereof is thus believed unnecessary for an understanding of the present invention.

Also located radially intermediate spindle housing 24 and spindle member 56 are low friction sealing means 68, one of sealing means 68 being located axially outward of each bearing assembly 58 to seal the axially opposite ends of space 60 against uncontrolled leakage of lubricant therefrom. Removable upper and lower cap members 70 and 72 are releasably secured with respect to spindle housing 24 and project radially inwardly thereof to assist in positioning and retaining sealing means 68. Each cap 70 and 72 is also provided with a suitable annular seal member 74 which contacts spindle member 56 axially outward of respective sealing means 68 to enhance seal performance.

Figure 3:
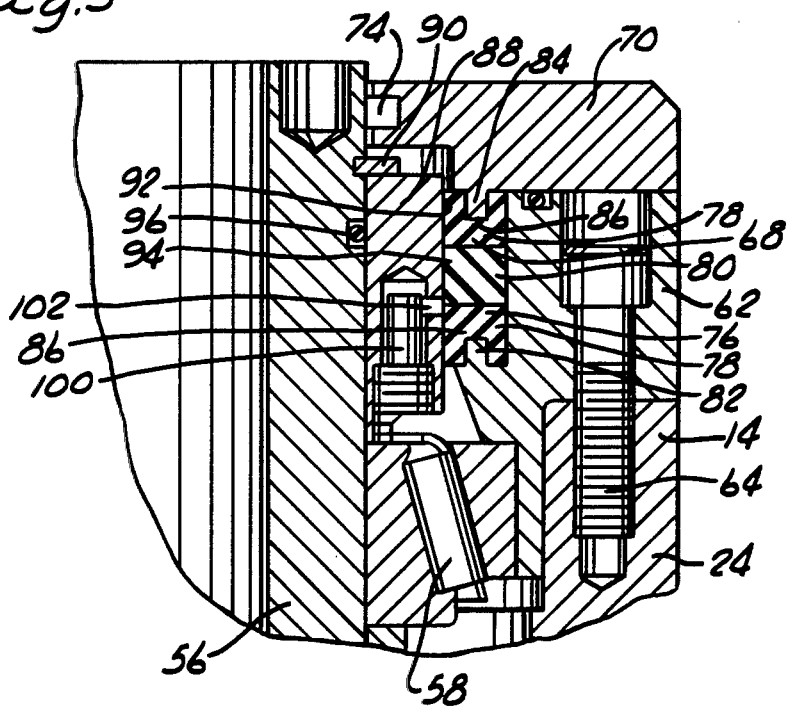
FIG. 3 is a fragmentary portion of FIG. 1.

Inasmuch as upper and lower sealing means 68 are entirely similar, only one, the upper sealing means 68, will be described herein, it being understood that the description thereof applies likewise to the lower sealing means 68. Referring to FIG. 3, there is shown a fragmentary portion of drilling head 10 including an upper end of spindle housing 24 with upper housing portion 62 secured thereto by bolts 64 and cap member 70 suitably secured atop housing portion 62 such that seal 74 carried thereby engages spindle member 56, which is located with respect to spindle housing 24 by bearing assembly 58.

Sealing means 68 preferably comprises an annular seal group 76 including a pair of axially-spaced-apart neoprene seal member 78 and an intervening nylon seal member 80. Seal members 78 are located and retained with respect to spindle housing 24 by means of axially projecting, formed annular ring portions 82 and 84 of housing member 24 and cap 70 respectively, the rings 82 and 84 being received within cooperably formed annular grooves 86 in neoprene seal members 78 in interlocking relationship therewith.

A sealed rotary interface is provided at the radially innermost surface 94 defined by seal group 76 for rotary sealing engagement with an annular ring 88 of chrome steel for example, which encompasses spindle member 56 and is non-rotatably retained with respect thereto as by a key (not shown) or other suitable means. Ring 88 is retained axially adjacent seal group 76 axially intermediate bearing assembly 58 and a snap ring 90 whereby the radially outer surface 92 of ring 88 engages the adjacent surface portion 94 of seal group 76 to form a low friction seal interface. Suitable O-ring seals may also be provided as at 96 to provide a sealed interface between spindle member 56 and ring 88.

To provide for lubrication of the relatively rotating parts of spindle assembly 14, a lubricant such as oil is provided under pressure to space 60 via an inlet connection 98 (FIG. 1) attached to housing 24 and to which is connected any suitable source of pressurized lubricant flow. The pressurized lubricant thus fills space 60 axially intermediate sealing means 68 at a pressure of, for example, 20 p.s.i.g. The pressurized lubricant thus completely submerges bearing means 58 and precludes entry of any foreign matter into space 60 as the lubricant pressure is sufficient to exceed the external pressure across all potential leakage interfaces to which the lubricant pressure is applied. To provide lubricant to sealing means 68, adjustable metering valves 100 (e.g. such as is available from Bijur Lubricating Company) are caused by ring members 88 to meter lubricant at a reduced pressure from space 60 to the rotary interface between ring 88 and seal group 76 via respective radial bores 102 which communicate within ring 88 between valve 100 and seal group 76. Accordingly, bearings 58 within space 60 are flooded with lubricant under pressure whereas the rotary seal interface between surfaces 92 and 94, which seals space 60 from the exterior, is lubricated with lubricant from space 60 at a reduced pressure.

A generally cylindrical stripper packer 104 formed from molded elastomeric material such as rubber is preferably molded integrally with a mounting ring 106 for mounting thereof as by screw threads 108 and/or set screws 110 upon the lowermost end of spindle member 56. Stripper packer 104 has relatively thick section side walls 112 which converge downwardly to provide a reduced diameter bore 114 smaller than the outside diameter of the drill spring and, through which the drill string may be passed. The diameter of bore 114 is suitably sized with respect to the outside diameter of the drill string that the resiliency of packer 104 is sufficient to sealingly grip the drill string passed therethrough with enough griping force that the rotation of the drill string will impact concomitant rotation to spindle assembly 14. The utilization of low friction sealing means 68 and bearings flooded with pressurized lubricant serves to reduce rotary friction sufficiently that the grip of packer 104 on a drill string is sufficient to overcome the frictional forces and impart rotation to the spindle without resorting to any other rotary drive connection.

As in prior packers, the seal interface provided between a drill string and packer 104 is intended to prevent leakage of drilling fluid from the drilling fluid circulation system. Thus, as for example in conventional forward circulation, the drilling fluid returns to the drilling head from the bottom of the bore hole via the annular cavity between the drill string and the well casing, and then is directed from the well bore via side connection 22.

In order to ensure that drilling fluid and the entrained debris do not penetrate to the lower sealing means 68, a labyrinth groove seal 116 is provided between adjacent relatively rotating formed portions of packer 104 and spindle housing 24. The labyrinth groove seal 116 provides a tortuous flow path which serves to prevent drilling fluid flow via the exterior periphery of packer 104 and between relatively rotating components to seal 74 thus arresting migration of debris toward the lower seal means 68.

According to the description hereinabove, there is provided by the present invention an improved drilling head wherein pressure flooded rotary bearings, low friction seals with lubrication metering, back-up labyrinth seals, and other friction reducing improvements permit the spindle assembly of the drilling head to be rotationally driven by the engagement between the resilient stripper packer and the rotating drill string.

These and other embodiments and modifications having been envisioned and anticipated by the inventor, the invention is to be construed as broadly as permitted by the scope of the claims appended hereto.

I claim:

1. In a drilling head adapted to provide a seal about the periphery of a drill string passed therethrough during drilling wherein the drilling head includes a stationary housing adapted to be mounted on a well casing and a rotary spindle assembly mounted for rotation with respect to the housing in sealed rotary bearings retained within said housing and wherein a sealing means forms a sealed rotary interface between the relatively rotatable housing and spindle assembly to contain bearing lubricant, the improvement comprising:

said drilling head including flow inlet means for directing a flow of lubricant to said rotary bearings for lubrication thereof and flow metering means for directing such lubricant from said bearing means to said sealing means at a predetermined limited flow rate whereby a flow of lubricant delivered under pressure to said flow inlet means is effective to provide drilling head lubrication in a manner that said rotary bearings are continuously flooded with lubricant at a relatively elevated pressure and sealing means is lubricated with a metered flow of lubricant at a relatively reduced pressure from that of the lubricant which lubricates said rotary bearings.

2. The improvement as claimed in claim 1, wherein said sealing means is exposed to lubricant from said rotary bearings at both said relatively elevated and said relatively reduced pressures.

3. The improvement as claimed in claim 2 wherein different portions of said sealing means are exposed respectively to said relatively elevated and relatively reduced pressures.

4. The improvement as claimed in claim 3, wherein said sealing means is a low friction seal means.

5. The improvement as claimed in claim 4, wherein said sealing means includes at least one seal group comprised of a pair of spaced apart relatively flexible seals and an intervening relatively inflexible seal.

6. The improvement as claimed in claim 5 wherein said relatively flexible seals are rubber seals and said relatively inflexible seal is nylon.

7. In a drilling head including a resiliently flexible packer for forming a seal about the periphery of a rotary drill string passed therethrough, the combination comprising:

a stationary housing adapted to be non-rotatably secured with respect to a well casing;

a spindle assembly which carries said packer and is rotatably mounted with respect to said stationary housing;

sealed bearing means for permitting relative rotation between said spindle assembly and said stationary housing;

means for flooding said bearing means with a flow of lubricant at a relatively elevated pressure to limit rotary bearing friction; and flow metering means for limiting the exposure of the seals of said sealed bearing means to such elevated pressure lubricant thereby permitting use of low pressure bearing seals whereby rotary friction between said housing and said spindle assembly is minimized.

8. The combination as claimed in claim 7, wherein said sealed bearing means includes at least a pair of spaced apart sealing means and at least one bearing assembly disposed intermediate said spaced sealing means.

9. The combination as claimed in claim 8, wherein at least one of said sealing means includes a seal group which forms a sealed rotary interface between said housing and said spindle assembly.

10. The combination as claimed in claim 9, wherein said flow metering means includes metering valve means for providing a metered flow of lubricant at a relatively reduced pressure to said seal group.

11. The combination as claimed in claim 10, wherein said metering valve means is carried by said spindle assembly.

12. The combination as claimed in claim 11, wherein said metered flow of lubricant is directed to a first portion of said seal group and another portion of said seal group is exposed to said lubricant at such relatively elevated pressure.

13. The combination as claimed in claim 12, wherein said seal group includes a pair of spaced apart, relatively soft seals and an intervening relatively hard seal.

14. The combination as claimed in claim 13, wherein said seal group forms a substantially continuous zone of sealed contact between said housing and said spindle assembly.

15. The combination as claimed in claim 7, wherein the sealing engagement of said packer on such drill string alone provides the requisite rotary drive connection for concomitant rotation of said spindle assembly with such drill string.

16. In a drilling head wherein a stationary housing carries a rotary spindle assembly which includes a resiliently flexible packer for providing a seal about the periphery of a rotary drill string passed therethrough, the method of imparting rotation to the rotary drill string passed therethrough, the method of imparting rotation to the rotary spindle assembly for rotation thereof with the drill string and with respect to the housing comprising the steps of:

resiliently deforming said packer by passing said drill string therethrough;

engaging said packer about the periphery of said drill string passed therethrough to provide a frictional grip on said drill string in response to the innate propensity of said packer to resile to an undeformed state; and limiting the rotary friction between said housing and said spindle assembly to a magnitude sufficiently less than the magnitude of friction between mutually engaged surfaces of said packer and said drill string that during relative rotation between said drill string and said housing said spindle assembly is rotated concomitantly with said drill string exclusively by the frictional engagement between said packer and said drill string.

17. In a drilling head including a stationary housing adapted to be non-rotatably secured with respect to a well casing and a spindle assembly which is rotatably mounted with respect to said stationary housing by sealed bearing means to permit relative rotation between said spindle assembly and said stationary housing, the combination comprising:

a resiliently flexible packer which is adapted to receive a rotary drill string in a manner to form a seal about the periphery of such a rotary drill string to provide the only rotary driving connection therewith; and means for limiting the friction of such sealed bearing means to a magnitude smaller than the friction of said rotary driving connection whereby rotary driving impetus applied to such a drill string will exclusively impart concomitant rotation to such spindle assembly.

* * * * *

UNITED STATES PATENT AND TRADEMARK OFFICE

CERTIFICATE OF CORRECTION

PATENT NO. : 4,531,591

DATED : July 30, 1985

INVENTOR(S) : Vaughn R. Johnston

It is certified that error appears in the above-identified patent and that said Letters Patent is hereby corrected as shown below:

In the Claim:

claim 16, lines 5 and 6, the words "the method of imparting rotation to the rotary drill string passed therethrough" are deleted.

Signed and Sealed this

Tenth Day of November 1998

Bruce Lehman

*Attest:*

BRUCE LEHMAN

*Attesting Officer*

*Commissioner of Patents and Trademarks*